US010738949B2

(12) United States Patent
Rieder et al.

(10) Patent No.: US 10,738,949 B2
(45) Date of Patent: Aug. 11, 2020

(54) SEMICONDUCTOR LAMP

(71) Applicant: LEDVANCE GmbH, Garching bei Munchen (DE)

(72) Inventors: Bernhard Rieder, Regensburg (DE); Shaozhu Yang, Shenzhen (CN)

(73) Assignee: LEDVANCE GMBH, Garching bei Munchen (DE)

( * ) Notice: Subject to any disclaimer, the term of this patent is extended or adjusted under 35 U.S.C. 154(b) by 0 days.

(21) Appl. No.: 15/765,372

(22) PCT Filed: Sep. 30, 2016

(86) PCT No.: PCT/EP2016/073444
§ 371 (c)(1),
(2) Date: Apr. 2, 2018

(87) PCT Pub. No.: WO2017/055566
PCT Pub. Date: Apr. 6, 2017

(65) Prior Publication Data

US 2018/0306387 A1 Oct. 25, 2018

(30) Foreign Application Priority Data

Oct. 2, 2015 (DE) ..... 10 2015 219 140

(51) Int. Cl.

| | |
|---|---|
| ***F21K 9/27*** | (2016.01) |
| ***F21K 9/275*** | (2016.01) |
| ***F21K 9/90*** | (2016.01) |
| ***F21V 19/00*** | (2006.01) |
| ***F21V 29/89*** | (2015.01) |

(Continued)

(52) U.S. Cl.
CPC ..... *F21K 9/275* (2016.08); *F21K 9/90* (2013.01); *F21V 19/0045* (2013.01); *F21V 29/70* (2015.01); *F21V 29/89* (2015.01); *F21Y 2103/10* (2016.08); *F21Y 2115/10* (2016.08)

(58) Field of Classification Search
CPC ..... F21K 9/27–278; F21Y 2103/10; F21V 19/003–0045
See application file for complete search history.

(56) References Cited

U.S. PATENT DOCUMENTS 8,950,890 B2 * 2/2015 Seki ..... F21V 23/002 362/217.05
9,303,860 B1 * 4/2016 Madireddi ..... B29C 47/0019
(Continued)

FOREIGN PATENT DOCUMENTS

DE 102010062331 A1 6/2012
DE 112012004028 T5 7/2014
(Continued)

*Primary Examiner* — Sean P Gramling
(74) *Attorney, Agent, or Firm* — Hayes Soloway PC

(57) ABSTRACT

A tubular semiconductor lamp having an elongate heat sink formed from sheet metal, at least one strip-shaped circuit board, which is equipped with at least one semiconductor light source and which lies on the heat sink, and a light-transmissive bulb made of plastic, which arches over the equipped circuit board, wherein the circuit board is held in a longitudinally movable manner by the heat sink. A method for producing a tubular semiconductor lamp, which can be applied, for example, to replacement lamps for straight-line fluorescent lamps or linear lamps, of type T5 or T8.

14 Claims, 3 Drawing Sheets

(51) Int. Cl.

| | |
|---|---|
| ***F21V 29/70*** | (2015.01) |
| *F21Y 103/10* | (2016.01) |
| *F21Y 115/10* | (2016.01) |

(56) References Cited

U.S. PATENT DOCUMENTS

| | | | | |
|---|---|---|---|---|
| 10,161,568 | B2 * | 12/2018 | Amrine, Jr. | F21V 19/003 |
| 2007/0165425 | A1 * | 7/2007 | Sakamoto | G02F 1/133608 362/633 |
| 2010/0008085 | A1 | 1/2010 | Ivey et al. | |
| 2012/0043884 | A1 * | 2/2012 | Lee | F21V 3/02 315/32 |
| 2012/0155095 | A1 | 6/2012 | Ryan, Jr. | |
| 2012/0201023 | A1 * | 8/2012 | Yoneda | F21V 15/013 362/218 |
| 2012/0236562 | A1 | 9/2012 | Tran | |
| 2013/0039051 | A1 * | 2/2013 | Wu | F21V 23/002 362/218 |
| 2014/0029249 | A1 * | 1/2014 | Matsukawa | F21V 23/002 362/218 |
| 2014/0240972 | A1 * | 8/2014 | Ye | F21V 19/004 362/217.13 |
| 2014/0369035 | A1 * | 12/2014 | Kika | F21K 9/27 362/217.17 |
| 2016/0084449 | A1 * | 3/2016 | Speer | F21K 9/66 362/223 |

FOREIGN PATENT DOCUMENTS

| | | | |
|---|---|---|---|
| JP | 2014063616 | A | 4/2014 |
| WO | 2015110306 | A1 | 7/2015 |

* cited by examiner

SEMICONDUCTOR LAMP

CROSS-REFERENCE TO RELATED APPLICATIONS

This application is a U.S. national phase entry under 35 U.S.C. § 371 of International Application No. PCT/EP2016/073444, filed on Sep. 30, 2016, which claims priority to German Patent Application No. 10 2015 219 140.0, filed on Oct. 2, 2015. Each of these patent applications is incorporated by reference herein in its entirety.

FIELD

The invention relates to a tubular semiconductor lamp comprising an elongate cooling body formed from sheet metal, at least one strip-shaped circuit board, which is equipped with at least one semiconductor light source and which rests on the cooling body, and a light-permeable envelope of plastics material arching over the equipped circuit board. The invention also relates to a method of producing a tubular semiconductor lamp. The invention is usable for, for example, replacement lamps for straight tubular lamps, particularly fluorescent lamps or linear lamps, particularly of type T5 or T8.

BACKGROUND

US 2012/155095 A1 discloses a cooling body and a method of producing a cooling body for an LED light-emitting body. The cooling body is produced by roll-profiling a thin aluminium sheet to form a heat dissipating structure, the heat dissipating structure having at least one surface which reflects light generated by the LEDs.

US 2010/0008085 A1 discloses a method of forming an LED-based lamp for replacement of a conventional fluorescent lamp in a fluorescent lamp light, wherein an elongate sheet of material with good thermal conductivity is shaped to create a heat sink. The shaping of the cooling body makes it possible to design the cooling body so that fastening structures for a cover and end caps, surfaces for mounting LEDs at different angles, and a large surface-to-width ratio for dissipation of heat may be defined.

The circuit board may be secured to the cooling body, which is constructed as a curved metal section, using various known forms of fastening, for example, gluing, screw-connection, welding, riveting, etc.

If conventional semiconductor lamps of the relevant kind are inserted horizontally into a mount, they distort downwardly by typically a few millimetres due to their intrinsic weight. Thus, lamps with a length of approximately 1.5 metres with a tubular polycarbonate envelope can bend downwardly, for example, approximately 3 to 4 millimetres. This also applies to conventional cooling bodies, as used in the past, of such semiconductor lamps in the form of extruded aluminium sections, which sag approximately 6 to 8 millimetres. When the semiconductor lamps are switched on, the temperature thereof at the upper side increases faster than at the lower side, so that the upper side expands at a greater rate than the lower side. As a result, bending of the lamp upwardly takes place and is frequently more pronounced than the sagging due to intrinsic weight. In that case, it may be disadvantageous that the bending of the semiconductor lamp can lead to a mismatch between the cooling body and the circuit board mounted thereon, as a result of which the attachment of the circuit board to the cooling body can be damaged. Damage of the attachment of the circuit board to the cooling body can also occur due to a thermal mismatch between the cooling body and the circuit board.

SUMMARY

It is the object of the present invention to at least partly overcome the disadvantages of the prior art and to provide an improved arrangement of the circuit board at a cooling body of semiconductor lamps of the relevant kind.

This object is fulfilled by the features of the independent claims. Preferred forms of embodiment may be inferred from, in particular, the dependent claims.

The object may be fulfilled by a tubular lamp (termed, without limitation of the generality, "semiconductor lamp" in the following) comprising an elongate cooling body formed from sheet metal, at least one strip-shaped circuit board equipped with at least one semiconductor light source that rests on the cooling body, and a light-permeable envelope of a plastic material arching over the equipped circuit board, wherein the circuit board is held by the cooling body so that they are longitudinally displaceable relative to one another.

This semiconductor lamp has the advantage that in the case of bending the circuit board and the cooling body, these can slide relative to one another in longitudinal direction and thus do not build-up stresses therebetween. Consequently, there may be no generation of stresses due to a thermal mismatch and/or lamp distortion.

It is a development that the circuit board is mechanically positively retained perpendicularly to the longitudinal axis thereof by the cooling body. The circuit board is prevented by the cooling body from freely moving in a direction perpendicular to its longitudinal axis. Alternatively or additionally, the circuit board can be retained at the cooling body by force couple or friction. In that case, the circuit board and the cooling body are in mutual contact, in particular, under adhesive friction. The frictional connection is particularly advantageous to press the circuit board onto the cooling body to keep thermal resistance between them as small as possible. This makes possible a particularly effective heat dissipation from the circuit board to the cooling body.

The tubular semiconductor lamp is, especially, a straight tubular semiconductor lamp.

The circuit board can be made from one piece or of integral construction. The circuit board can also be composed of several separately produced sub-sections, for example, clipped together or plugged together.

It is a further development that the metal sheet is a profile-like metal sheet, thus its cross-sectional shape is maintained over its entire length at least substantially (for example, apart from shaping at end regions or apart from small deviations).

In principle, the method of shaping the metal sheet is not limited and can comprise, for example, punching, cutting and reshaping, particularly cold reshaping, especially reshaping by bending, particularly roller forming or roll profiling.

The cooling body produced from the metal sheet is, especially, profile-shaped.

It is a development that the cooling body has the form of a channel or, in cross-section, a dish-like basic shape. This gives the advantage that the cooling body can rest by its outer side over a large area against an inner side of the envelope to achieve a particularly effective thermal transmission. In addition, an inner side of the cooling body, at which also the circuit board is arranged, can then be used as a dish-shaped or channel-shaped reflector to keep the light output particularly high. It is thus a development that the cooling body has an outer support surface for support at an inner side of the envelope and an inner support surface for support of the circuit board.

In particular, the at least one semiconductor light source comprises at least one light-emitting diode. If several light-emitting diodes are present, they can light up in the same colour or in different colours. A colour can be monochrome (for example, red, green, blue, etc.) or multichrome (for example, white). In addition, the light emitted by the at least one light-emitting diode can be an infrared light (IR LED) or an ultraviolet light (UV LED). A plurality of light-emitting diodes can generate a mixed light, for example, a white mixed light. The at least one light-emitting diode can contain a wavelength-converting light source (conversion LED). The light source can alternatively or additionally be arranged remotely from the light-emitting diode ('remote phosphor'). The at least one light-emitting diode can be present in the form of at least one individually housed light-emitting diode or in the form of at least one LED chip. A plurality of LED chips can be mounted on a common substrate ('submount'). The at least one light-emitting diode can be equipped with at least one individual and/or common optical system for beam guidance, for example at least one Fresnel lens, collimator and so forth. Instead of or in addition to inorganic light-emitting diodes, for example, InGaN or AlInGaP, in general, organic LEDs (OLEDs, for example, polymer OLEDs) are also usable. Alternatively, the at least one semiconductor light source can comprise, for example, at least one diode laser.

The circuit board can be a flexible or easily bendable circuit board. Alternatively, the circuit board can be a stiff circuit board which is not intended to be bent or can be resiliently bent only slightly. The displaceability relative to the cooling body in a longitudinal direction allows use of a stiff circuit board.

The resting of the circuit board on the cooling body can include, in particular, the circuit board being equipped only at one flat side with at least one semiconductor light source and resting by its other flat side over an area, especially the full area, on the cooling body. A particularly effective heat dissipation of the waste heat, which is generated by the LEDs, by way of the circuit board to the cooling body can thus be achieved.

It is a development that the light-permeable envelope is a tubular envelope in which the at least one cooling body is received. Alternatively, the envelope can be seated on the cooling body, for example, an envelope which is open or cut open in its longitudinal direction. The cross-sectional shape of the envelope can be circularly annular at least in a section or sector, but in principle also oval, multi-cornered (for example, polygonal or faceted), or of free shape, etc. In particular, the envelope can be formed in cross-section to be flat at a section so as to facilitate area contact with the cooling body.

When the at least one cooling body is received in the tubular envelope, the cooling body can, for example, rest, in particular, over an area against an inner side of the envelope. For particularly effective heat dissipation by way of the envelope, the cooling body can be pressed against the envelope. For that purpose, the cooling body can be clamped in place in the envelope.

The envelope can be translucent and/or transparent.

The plastics material can consist of or comprise, for example, PC, PMMA, ABS, etc.

The semiconductor lamp has end caps by means of which it fits in conventional mounts for the lamp to be replaced. The end caps can be compatible with, for example, sockets of type G5 or G13. It is not necessary for the two end caps to also produce, apart from a mechanical connection, an electrical connection, but it is possible.

An embodiment advantageous for compensation for thermally induced longitudinal expansion is provided when the cooling body and/or the at least one circuit board are secured to end caps of the semiconductor lamp, for example by a detent connection, whilst the envelope is held by the end caps to be floating in a longitudinal direction. It is thus possible to compensate in simple manner for different thermal expansion of the envelope on the one hand and the circuit board or cooling body on the other hand. In that case, the cooling body and/or the at least one circuit board can be fastened to the end caps of the semiconductor lamp directly or by way of, for example, a rail (e.g., of steel).

In an embodiment, the cooling body has bent-out sub-regions (termed "straps" in the following without limitation of the generality) to hold the circuit board on the cooling body. This gives the advantage that the cooling body can have a particularly simple basic shape. In addition, production of the straps needs less material. The sub-region can also be termed 'lug'. The bent-out straps can, for example, connect to the rest of the cooling body only at a bending line and otherwise separate therefrom.

The straps can be bent, in particular, in a spatial region above the inner support surface for the circuit board so that they prevent the circuit board from appreciably lifting off the inner support surface, and in addition, can press the circuit board against the inner support surface of the cooling body in the case of a frictional connection with the cooling body.

In a development the cooling body has several straps on both sides of the inner support surface to hold the circuit board uniformly on both sides.

It is additionally an embodiment that several straps are arranged in a longitudinal direction of the cooling body in a row at a mutual spacing. This makes possible a particularly uniform retention, particularly pressing, of the circuit board at or against the cooling body.

It is a development that a spacing of adjacent straps or lugs along the length direction of the cooling body is no more than 20 centimetres, and in particular, not more than 10 centimetres, to prevent appreciable lifting of the circuit board off the cooling body.

It is additionally a development that the width of the straps between the junction thereof with the rest of the cooling body and the opposite free ends thereof is 5 to 10 millimetres.

It is a further development that the cooling body has at least one inwardly protruding indentation to hold the circuit board on the cooling body. As a result, the cooling body can be shaped by means of a bending process to hold the circuit board or circuit boards without needing to punch out straps, etc. A metal sheet bent in cross-section in that way is in addition less susceptible to sagging, since the indentation can also serve as a reinforcing rib. This embodiment can be realised advantageously particularly in the case of use of metals other than aluminium (for example steel) as the material of the cooling body.

In particular, the cooling body can have at least two indentations present on opposite sides of the inner support surface—in particular elongate indentations extending in longitudinal direction—in order to hold the circuit board on both sides.

The cooling body can have one or more indentations on each side, in which case for the sake of simple production—particularly by roll profiling—exactly one projection per side is advantageous.

It is additionally a development that the at least one indentation extends over at least 50% of the length of the circuit board. The circuit board can thus be securely retained. The indentation can extend over the entire length of the circuit board.

In an embodiment advantageous for simple production exactly one indentation, which extends over the entire relevant length of the cooling body, is present per side of the inner support surface.

In particular, the indentation can extend in longitudinal direction from edge to edge of the cooling body. Other sections of the cooling body can extend in length direction even further beyond these edges.

Use of steel, in particular, as the metal is advantageous, since steel permits appreciably less bending than aluminium and can be bent without problems. In particular, steel, in contrast to aluminium, can tolerate even stronger cold-shaping without cracks.

It is a development advantageous for economic, accurate, and rapid production that the cooling body is produced from the metal sheet by roller-forming or roll-profiling.

In yet a further embodiment at least one indentation has a folded-over or flanged-over region ('fold region'). This makes possible a particularly precise shaping and arrangement of the indentation as well as a particularly wide projection beyond the inner support surface. In particular, folded-over plate sections lie one on the other in a fold region. A circuit board can then be pushed in simple manner into the cooling body and is held between the at least one indentation and the inner support surface, particularly in a clamping fit.

It is a development that the width of the fold region, which indicates how far the fold region extends inwardly, is between 0.5 millimetres and 1 millimetre. Production is considerably more difficult in the case of smaller values, and in the case of larger values, the use of material increases and disadvantageously brings a smaller electrical leakage path to voltage-conducting surface regions of the circuit board (conductor tracks, contacts, etc.).

It is also an embodiment that the envelope is a tubular envelope in which the at least one cooling body is received, that the envelope has inwardly projecting projections for retention of the cooling body and that the cooling body is, in particular, so clamped in place in the envelope by means of the projections of the envelope that the cooling body is pressed against the inner side of the envelope. Thus, the cooling body can be securely held in the envelope in simple manner.

It is also an embodiment that the cooling body is a steel sheet painted, especially painted white, at least regionally. Such a steel sheet diffusely reflects light, which is incident thereon, with a high level of efficiency so that light losses can be kept low. Steel sheet, in particular, has an advantage in comparison with an aluminium sheet, that steel can be painted before reshaping, and accordingly, it is possible to dispense with difficult painting of the sheet deformed to form the cooling body.

It is additionally an embodiment that the sheet thickness of the cooling body is between approximately 0.3 millimetres and approximately 0.5 millimetres, in particular, a steel sheet. A sheet thickness of less than approximately 0.3 millimetres can result in a mechanically unstable cooling body. A sheet thickness above approximately 0.5 millimetres increases material consumption and weight without yielding noticeably improved heat dissipation.

It is additionally also an embodiment that the side edges of the cooling body are bent over. This gives that advantage that bending or twisting of the side edges can be avoided in simple manner.

The object is also fulfilled by a method for producing a tubular semiconductor lamp as described above. The method can be formulated analogously to the semiconductor lamp and gives the same advantages.

It is thus an embodiment that a sheet is bent over to form an elongate cooling body, at least one circuit board equipped with at least one semiconductor light source is attached in clamping manner to the cooling body (especially pushed thereinto) and the cooling body is inserted (especially pushed) in a clamping manner into an at least partly light-permeable envelope of plastics material. Alternatively, the circuit board can also be inserted into the cooling body already inserted into the envelope.

It is additionally an embodiment that the sheet is a steel sheet. In addition, in the case of the method, the steel sheet can be painted white before it is bent over to form an elongate cooling body.

BRIEF DESCRIPTION OF THE DRAWINGS

The above-described properties, features and advantages of this invention as well as the mode and manner in which these are achieved are more clearly and plainly understandable in conjunction with the following schematic description of embodiments, which are explained in more detail in connection with the drawings. In that case, for the sake of clarity the same or equivalent elements are provided with the same reference numerals.

FIG. 1 shows, in a view obliquely from above, a detail of a cooling body 1 for a tubular semiconductor lamp H1 according to a first embodiment. FIG. 2 shows the cooling body 1 in cross-section. The cooling body 1 has a channel-like basic form, which can also be termed dish-like in cross-section.

Figure 1:
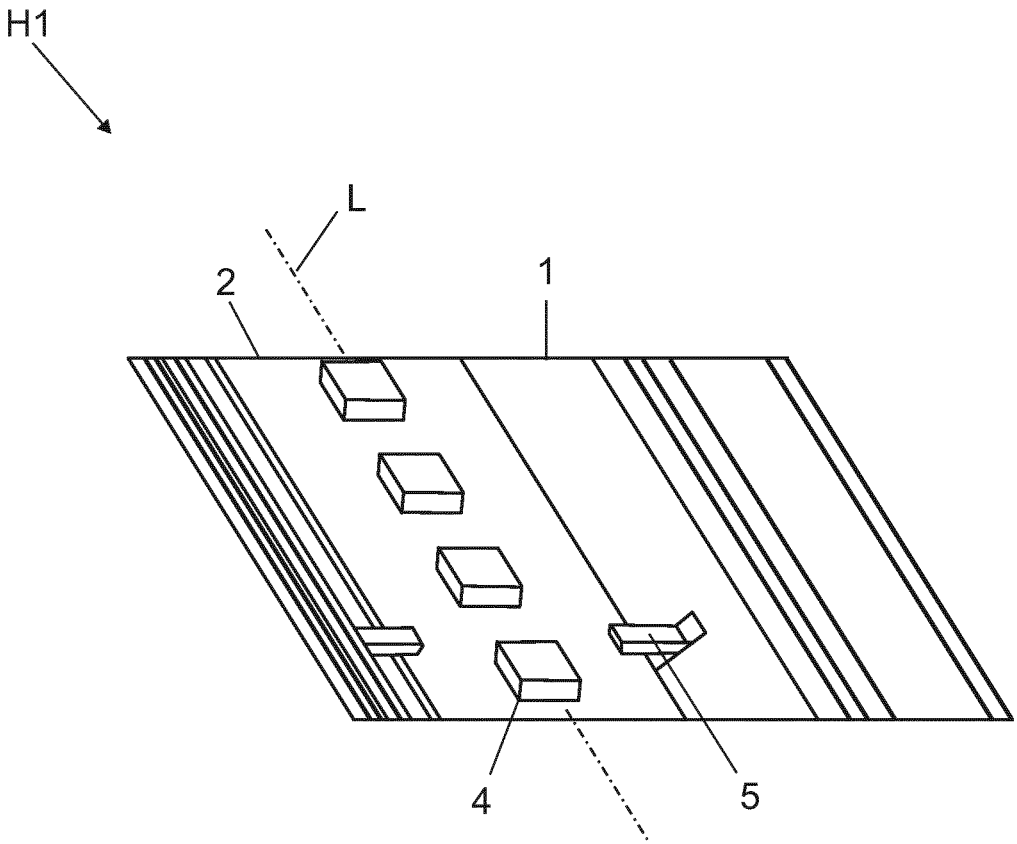
FIG. 1 shows, in a view obliquely from above, a detail of a cooling body for a tubular semiconductor lamp according to a first embodiment, at which a strip-shaped circuit board is mounted.
Figure 2:
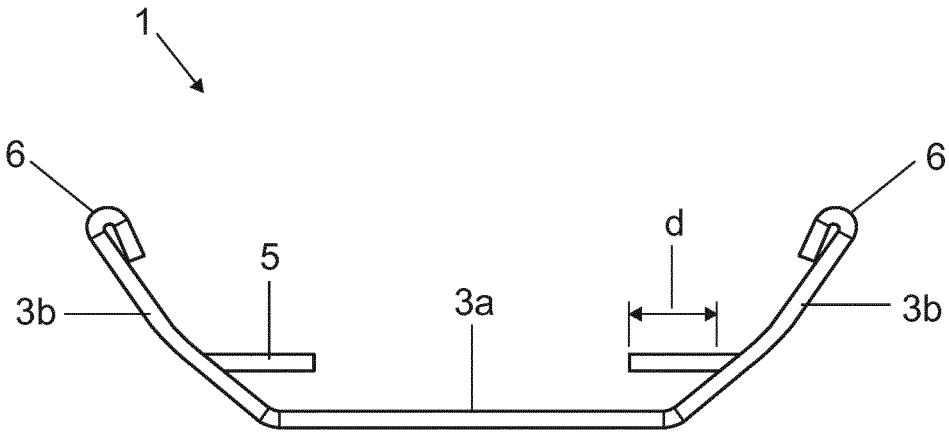
FIG. 2 shows the cooling body according to the first embodiment in cross-section.

A strip-shaped circuit board 2 is mounted on an inner side of the cooling body 1. The circuit board 2 extends along longitudinal axis L, which also corresponds with a longitudinal axis of the cooling body 1, or at least lies parallel thereto.

The circuit board 2 rests by its unequipped rear side over an area on a planar (inner) support surface 3*a* of the cooling body 1, whilst its front side is equipped with a plurality of LED chips 4 arranged in a row and radiating, for example, white light. Lateral side regions 3*b*, which can also serve as, in particular, reflector walls of the cooling body 1, extend away from the support surface 3*a*. The side regions 3*b* are curved in cross-section, for example, in the form of a sector of a circle, and are strip-shaped in the longitudinal direction.

The cooling body 1 consists of a reshaped, in particular bent over, section-like steel sheet with a thickness of between 0.3 and 0.5 millimetres, which prior to reshaping thereof, was coated, for example, painted, with a white coating (without illustration) with a high degree of reflectivity (for example, at least 90%, particularly at least 95%, especially at least 98%). The white coating produces a diffuse dispersion of the light incident thereon, particularly from the inner side of the side regions 3*b*.

The circuit board 2 is pressed by bent-out straps 5 of the cooling body 1 onto the support surface 3*a*. The straps 5 in that cases have a width d, by which they protrude from the rest of the cooling body 1, of between five and ten millimetres. The straps can be formed by, for example, laser-cutting, punching, etc., from the original steel sheet and then bent over. A mechanically positive and optionally also frictional retention of the circuit board 2 at the cooling body 1 perpendicularly to the longitudinal axis L is produced by the straps 5, but allows displacement of the circuit board 2 relative to the cooling body 1 in length direction of the longitudinal axis L ('longitudinal direction'). The cooling body 1 has, on each side of the circuit board 2, a respective plurality of straps 5 arranged in a row at a mutual spacing in longitudinal direction of the cooling body 1, for example, at a spacing of less than 10 centimetres.

The cooling body 1 has at its lateral boundaries an edge 6 which is bent over or turned over, here inwardly, in U-shape.

Figure 3:
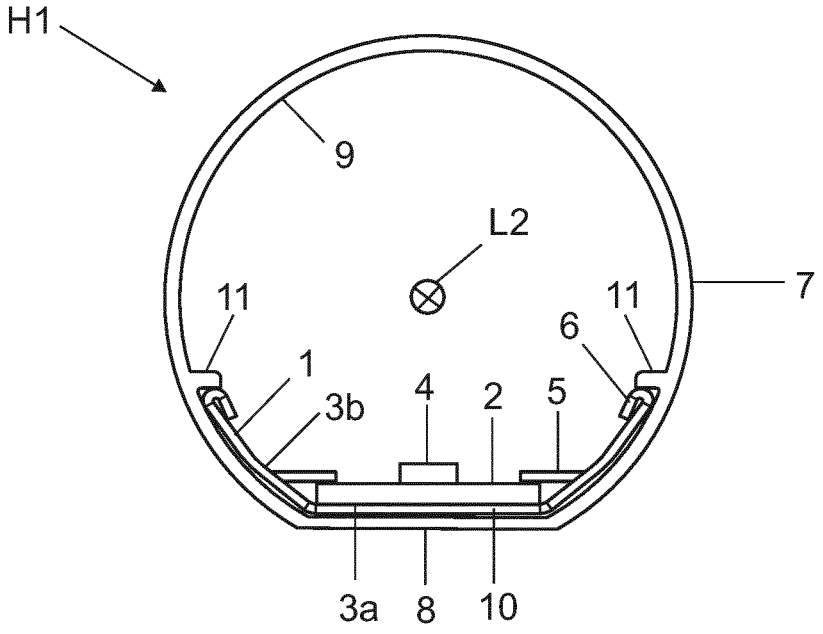
FIG. 3 shows the semiconductor lamp according to the first embodiment in cross-section.

FIG. 3 shows the semiconductor lamp H1 in cross-section. The circuit board 2 is held in the cooling body 1, whilst the cooling body 1 is held in clamping manner in a light-permeable envelope 7. The envelope 7 is a rectilinear tubular envelope of a plastic material which has the shape of a circular ring apart from a flat base section 8. The envelope 7 thus arches over the circuit board 2 equipped with the LED chips 4. The envelope 7 has a longitudinal axis L2 extending parallel to the longitudinal axis (not shown) of the circuit board 2.

The cooling body 1 nests by its outer side virtually over the whole area against an inner side 9 of the envelope 7 and, in particular, so that a planar strip-shaped base 10 of the cooling body 1, which at the inner side forms the inner support surface 3*a*, rests on the planar base section 8 of the envelope 7. A particularly effective heat transmission from the cooling body 1 to the envelope 7 is thus achieved.

The envelope 7 additionally has inwardly projecting projections 11 on both sides of the base section 8 and at a spacing therefrom. The turned-over edges 6 of the cooling body 1 press from below against the projections 11, which serve as abutments for the cooling body 1. The cooling body 1 is thereby clamped in place in the envelope 7, in which case its outer side is pressed against the inner side 9 of the envelope 7. The cooling body 1 is consequently held in clamping manner in the envelope 7.

Figure 4:
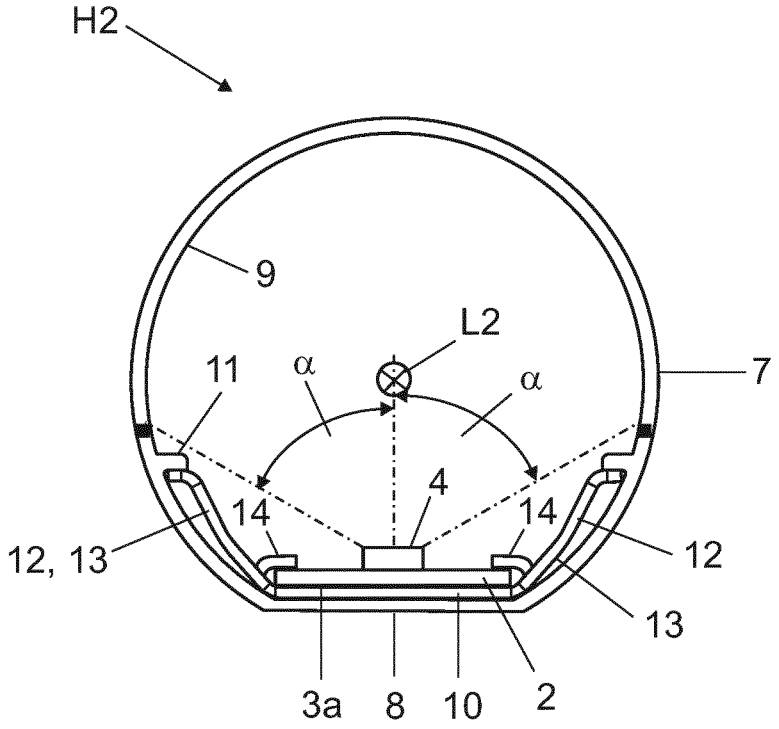
FIG. 4 shows, in cross-section, a semiconductor lamp according to a second embodiment.

FIG. 4 shows in cross-section a semiconductor lamp H2 according to a second embodiment. The semiconductor lamp H2 is constructed similarly to the semiconductor lamp H1 and comprises, for example, the same envelope 7 and the same circuit board 2, but a different cooling body 12.

Thus, the cooling body 12 now does not have a turned-over edge 6. In addition, the side regions 13 going out at both sides from the base 10 of the cooling body 12 are now bent in inwardly by comparison with a circularly annular shape to achieve a greater spring travel for clamping the cooling body 12 in place. The side regions 13 additionally now have straps 14 for holding the circuit board 2, these straps having been bent over from below upwardly around the circuit board 2. In that case, the circuit board 2 can be placed, for example, prior to insertion into the envelope 7, on the cooling body 12 to bend the straps 14 laterally around the circuit board 2.

As also in the case of the semiconductor lamp H1, the inwardly projecting projections 11, which also determine the height of the reflective cooling body 1 or 12, are arranged at a height which allows virtually unobstructed radiation of the light emitted by the LED chips 4, with an opening angle of 120° (corresponding to a half opening angle $\alpha$ of 60°) and thus a wide radiation.

Figure 5:
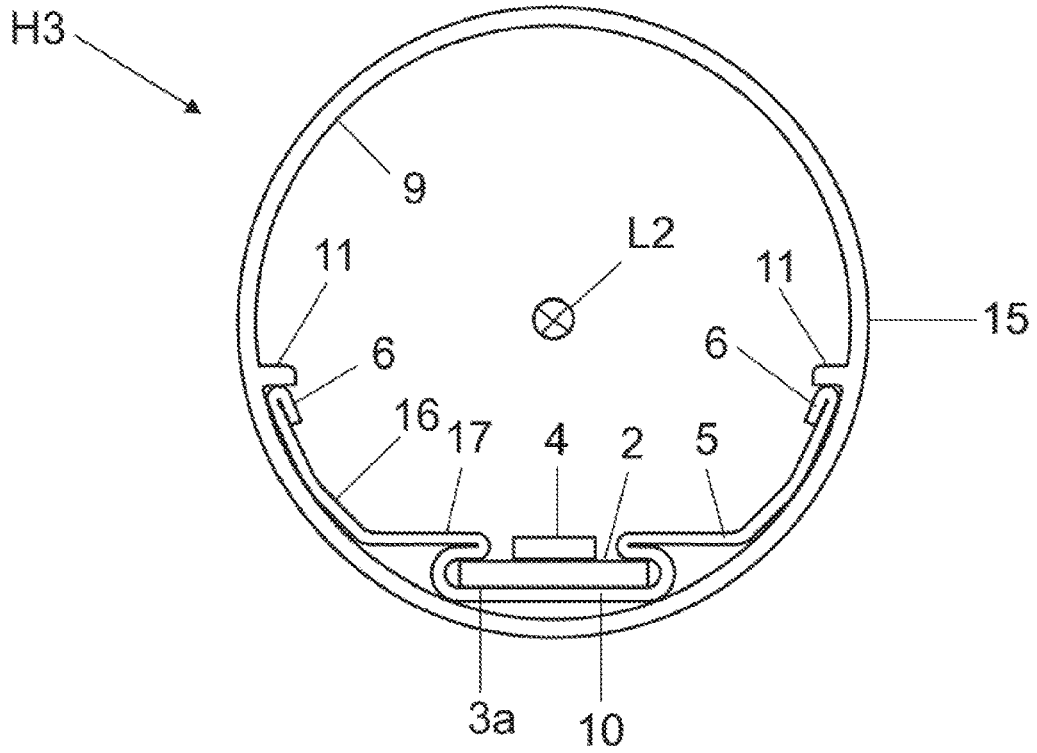
FIG. 5 shows, in cross-section, a semiconductor lamp according to a third embodiment.

FIG. 5 shows in cross-section a semiconductor lamp H3 according to a third embodiment. The semiconductor lamp H3 now has an envelope 15, which is entirely of circularly annular shape in cross-section, with projections 11 at the inner side.

The cooling body 16 now does not have any straps in order to hold the circuit board 2, but uses for that purpose inwardly protruding indentations 17 departing from the circular shape at both sides. The indentations 17 have been formed from the original metal sheet by cold deforming. The indentations 17 are, in particular, elongate indentations extending in longitudinal direction. The indentations 17 here extend over the appropriate entire length of the cooling body 16, which gives the advantage that they can be produced in simple manner by roller-shaping or roll-profiling. The indentations 17 can also be termed ribs. The indentations 17 hold the circuit board 2 in a clamping fit with the inner support surface 3*a*.

Since the inner support surface 3*a* is flat, the base 10 of the cooling body 1 here does not rest by its rear side over the whole area on the envelope 15.

Figure 6:
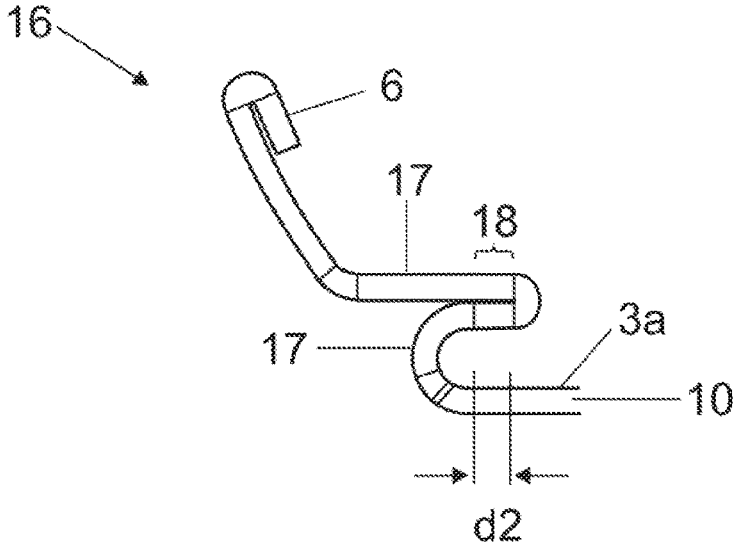
FIG. 6 shows, in cross-section, a detail of a cooling body of the semiconductor lamp according to the third embodiment.

FIG. 6 shows in cross-section a detail of the cooling body 16 in the region of one of the two indentations 17. The indentation 17 is formed as a turned-over projection with a fold region 18. The original metal sheet has been turned over, in particular, in a mutually contacting manner at the fold region 18. The fold region 18 has a width d2 of approximately 0.5 millimetres to 1 millimetre.

Although the invention has been illustrated and described more closely in detail by the depicted embodiments the invention is not restricted thereto and other variations can be derived therefrom by the expert without departing from the scope of protection of the invention.

Thus, a turned-over edge 6 can also be used in the case of the semiconductor lamp H2 and an edge, which is not turned-over, optionally with inwardly bent side regions 13, can be used in the case of the semiconductor lamps H1 and H3. Moreover, bent-over straps 14 can be used in the case of the semiconductor lamp H1 or the straps 5 in the case of the semiconductor lamp H2. In addition, for example, a cooling body can have several mutually spaced indentations 17 arranged in succession in a row.

In general, there can be understood by "a"/"one", etc., a single or multiple, particularly in the sense of "at least one" or "one or more", etc., provided this is not explicitly excluded, for example by the expression "exactly one", etc.

In addition, a numerical statement can embrace exactly the indicated number and also a usual tolerance range as long as this is not explicitly excluded.

| Reference numeral list | |
|---|---|
| 1 | cooling body |

-continued

| Reference numeral list | |
|---|---|
| 2 | circuit board |
| 3a | support surface of the cooling body |
| 3b | side region of the cooling body |
| 4 | LED chip |
| 5 | strap |
| 6 | turned-over edge |
| 7 | envelope |
| 8 | base section of the envelope |
| 9 | inner side |
| 10 | base of the cooling body |
| 11 | projection of the envelope |
| 12 | cooling body |
| 13 | side region |
| 14 | strap |
| 15 | envelope |
| 16 | cooling body |
| 17 | indentation |
| 18 | fold region |
| d | width of the strap |
| d2 | width of the fold region |
| H1 | semiconductor lamp according to the first embodiment |
| H2 | semiconductor lamp according to the second embodiment |
| H3 | semiconductor lamp according to the third embodiment |
| L | longitudinal axis of the circuit board |
| L2 | longitudinal axis of the envelope |
| α | half opening angle |

The invention claimed is:

1. A tubular semiconductor lamp comprising:

an elongate cooling body at least partially formed from sheet metal;

at least one strip-shaped circuit board, which is equipped with at least one semiconductor light source and which rests on the cooling body; and a light-permeable envelope of plastics material arching over the equipped circuit board and enveloping the cooling body;

wherein the circuit board is held to the cooling body by a physical feature formed from the sheet metal of the cooling body such that, in being so held, the circuit board remains longitudinally displaceable with respect to the cooling body; wherein the physical feature of the cooling body comprises bent-out straps formed from the sheet metal of the cooling body; and wherein several straps are arranged in a row at a mutual spacing in a longitudinal direction of the cooling body.

2. The semiconductor lamp according to claim 1, wherein:

the envelope is configured as a tubular envelope in which the at least one cooling body is received;

the envelope has inwardly projecting projections; and the cooling body is clamped in the envelope by the projections of the envelope such that the cooling body is pressed against an inner side of the envelope.

3. The semiconductor lamp according to claim 1, wherein the sheet metal of the cooling body is painted white at least regionally.

4. The semiconductor lamp according to claim 1, wherein the sheet metal of the cooling body has a thickness between 0.3 millimetres and 0.5 millimetres.

5. The semiconductor lamp according to claim 1, wherein side edges of the cooling body are bent over.

6. The semiconductor lamp according to claim 1, wherein the cooling body is formed substantially from sheet metal.

7. The semiconductor lamp according to claim 1, wherein the cooling body is formed entirely from sheet metal.

8. The semiconductor lamp according to claim 1, wherein the cooling body is generally disc-shaped in cross-section such that a trough of the disc-shaped cooling body lies adjacent an inner side of the envelope.

9. The semiconductor lamp according to claim 1, wherein the cooling body is generally U-shaped in cross-section such that a region of a vertex of the U-shaped cooling body lies adjacent an inner side of the envelope.

10. The semiconductor lamp according to claim 1, wherein the cooling body has a generally planar strip-shaped base portion that rests on a planar base section of the envelope.

11. The semiconductor lamp according to claim 1, wherein the physical feature formed from the sheet metal of the cooling body provides for at least one of mechanically positive retention and frictional retention of the circuit board with respect to the cooling body.

12. The semiconductor lamp according to claim 1, wherein the physical feature formed from the sheet metal of the cooling body provides for both mechanically positive retention and frictional retention of the circuit board with respect to the cooling body.

13. The semiconductor lamp according to claim 1, wherein the cooling body nests concentrically interior of an inner side of the envelope.

14. A method of producing a tubular semiconductor lamp, in which:

a steel sheet is painted white;

the steel sheet is bent around to form an elongate cooling body;

at least one circuit board equipped with at least one semiconductor light source is fixed to the cooling body by clamping via a physical feature formed from the steel sheet of the cooling body such that, in being so clamped, the at least one circuit board remains longitudinally displaceable with respect to the cooling body, wherein the physical feature of the cooling body comprises bent-out straps formed from the sheet metal of the cooling body; and wherein several straps are arranged in a row at a mutual spacing in a longitudinal direction of the cooling body; and the cooling body is introduced in clamping manner into an at least partly light-permeable envelope of plastics material such that the envelope envelops the cooling body.

* * * * *